United States Patent [19]

Gillam

[11] Patent Number: 4,583,640

[45] Date of Patent: Apr. 22, 1986

[54] PACKAGING ARRANGEMENT FOR ELECTRICAL CONNECTORS

[75] Inventor: Paul T. Gillam, Basingstoke, United Kingdom

[73] Assignee: Molex Incorporated, Lisle, Ill.

[21] Appl. No.: 612,483

[22] Filed: May 21, 1984

[30] Foreign Application Priority Data

Jun. 29, 1983 [GB] United Kingdom ..... 8317678

[51] Int. Cl.[4] ..... B65D 65/00

[52] U.S. Cl. ..... 206/328; 206/820; 220/23.4

[58] Field of Search ..... 206/820, 328, 343, 330, 206/329; 339/278 R, 256, 258 R; 220/23.4

[56] References Cited

U.S. PATENT DOCUMENTS

| | | | |
|---|---|---|---|
| 2,815,124 | 12/1957 | Pellier | 206/330 |
| 2,964,171 | 12/1960 | Chadwick | 206/330 |
| 3,129,814 | 4/1964 | Cheh et al. | 206/330 |
| 3,140,773 | 7/1964 | Cheh | 206/329 |
| 3,431,548 | 3/1969 | Busler | 339/278 R |
| 3,550,067 | 12/1970 | Hansen | 339/256 |
| 3,701,079 | 10/1972 | Bowden et al. | 220/23.4 |
| 3,774,756 | 11/1973 | Carlile et al. | 206/343 |
| 3,869,563 | 3/1975 | Ocken, Jr. | 226/23.4 |
| 4,383,724 | 5/1983 | Verhoeven | 339/258 R |

*Primary Examiner*—Joseph Man-Fu Moy

*Attorney, Agent, or Firm*—Louis A. Hecht; Bruce R. Mansfield

[57] ABSTRACT

A packaging arrangement for a plurality of electrical connector assemblies includes a carrier strip having a row of connector housings formed integrally therewith along like edges of the housings. Extending from one side of the carrier are protrusion means for spacing multiple carriers laterally apart in parallel adjacent relationship. Integrally formed latching means extend outwardly of the protrusion means and are receivable by an aperture or slot of the adjacent carrier for securing rows of connectors together.

7 Claims, 8 Drawing Figures

PACKAGING ARRANGEMENT FOR ELECTRICAL CONNECTORS

BACKGROUND OF THE INVENTION

1. Field of the Invention

This invention relates to electrical connector construction and, more particularly, to construction of miniature connectors for use in the electrical interconnection of printed circuit board components or assemblies.

2. Description of the Prior Art

A wide variety of electrical connectors are commercially available for use in the construction of electrically operated equipment and products. Electrical connectors of a miniature variety are particularly suitable for such applications as telecommunications or data processing equipment wherein it is customary to utilize printed circuit board assemblies having pin terminals for providing for the basic circuitry requirements and electrical connections, respectively, of the equipment. Typically, in such applications, electrical signals are conducted between board assemblies of components by means of electrical cable or wiring which for purposes of manufacturing and maintenance expediency have been terminated with electrical connectors.

Such a connector typically comprises a dielectric housing formed by conventional molding techniques and fitted with one or more conductive terminals for providing electrical connection between the cable or wiring and the circuit board pins or between adjacent pins when the connector is adapted for use as a shunt. Additionally, for manufacturing and handling convenience it may be desirable to mold the housings in a manner such that they are joined together in a continuous row by a discardable, break-away carrier strip formed integrally with the housings. The carrier strip facilitates ease of assembly, inasmuch as a plurality of connectors can be conveniently maintained in uniform controlled orientation and progression during various steps in the manufacturing process. A representative example of continuous molding employing carrier strip technique is disclosed in U.S. Pat. No. 4,193,658. In preparation for shipment, the connectors are either severed from the carrier strip and packaged loosely, or the carrier with the connectors attached is wound into a roll. In either case, the packaging of the connectors involves considerable bulk and subsequent handling of the connectors is attended by considerable inconvenience, particularly in the case of loosely packaged product.

SUMMARY OF THE INVENTION

One object of the present invention is to provide a plurality of miniature connectors which may be efficiently assembled in manufacture and may be more easily handled after assembly. A further object is to provide a plurality of miniature connectors which may be conveniently and compactly packaged for shipment to the user.

The foregoing objectives are realized in the illustrative embodiment of the present invention, wherein a plurality of miniature connectors are formed integrally with a carrier strip having multiple protrusion means extending from one side of the carrier at preselected intervals for spacing the carrier strip laterally apart from a second carrier strip arranged in parallel adjacent relationship to the first carrier strip. Each protrusion means is further adapted with resilient latching means for selectively securing the two carrier strips together. The protrusion means are dimensioned such that when the two carriers are secured together, the housings of the respective carriers are oriented in substantially parallel relationship one to another such that multiple rows of connectors may be secured together in a compact convenient arrangement.

BRIEF DESCRIPTION OF THE DRAWINGS

The structure and advantages of a plurality of electrical connectors in accordance with the invention will be better understood from consideration of the detailed description of an illustrative embodiment thereof which follows, when taken in conjunction with the accompanying drawings in which.

DESCRIPTION OF THE PREFERRED EMBODIMENT

Figure 1:
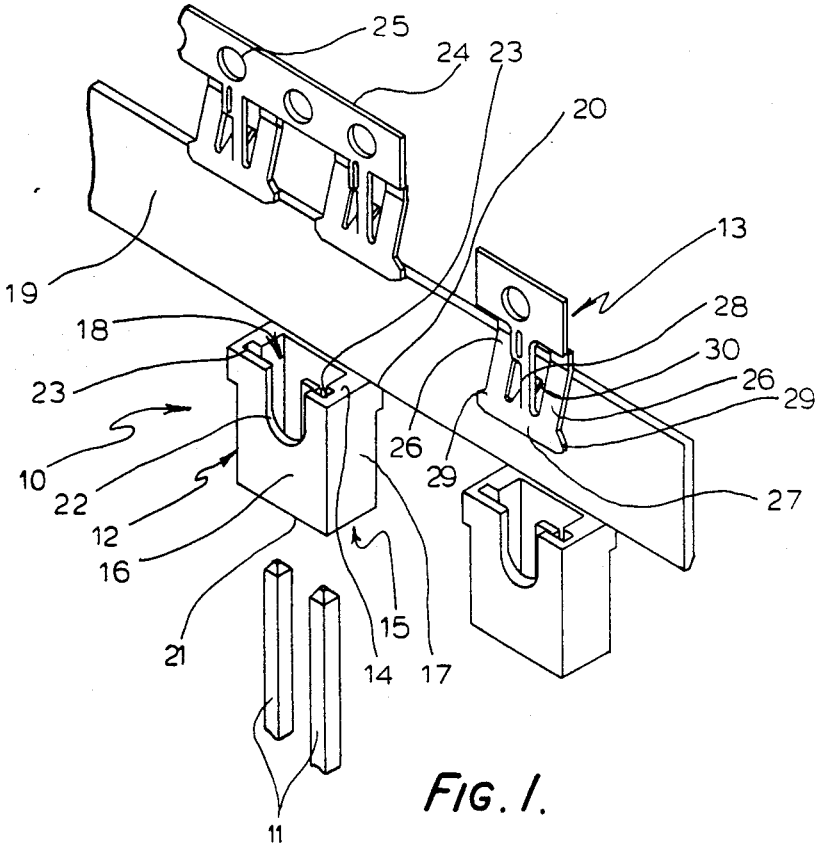
FIG. 1 is an exploded perspective view of a miniature shunt connector incorporating the present invention and illustrating the component parts of the connector prior to assembly.

Referring first to FIG. 1, a plurality of miniature shunt connectors, each designated generally by the reference numeral 10, are shown in exploded perspective as they would appear prior to assembly. The illustrative connector 10 is adapted for electrically shunting a pair of male terminal pins, designated generally by the reference numeral 11. Each shunt connector 10 comprises a dielectric housing, designated generally by the reference numeral 12, and a metalic terminal element, designated generally by reference numeral 13. Preferably, and in accordance with the present invention, the housings 12 are identical in their construction, each having an open end 14 for receiving the terminal 13, a pin receiving end 15, a pair of opposed side walls 16, and a pair of opposed end walls 17 which together define a cavity 18 within which the terminal 13 may be inserted and housed.

Molded integrally with the housings 12 is a carrier strip 19 which serves to join the housings 12 together in a continuous row comprising any preselected number of units. For reasons which will be explained in greater detail hereinafter, each housing 12 is preferably joined to the carrier strip 19 along a housing edge 20 formed between a sidewall 16 and the terminal receiving end 14. Although not specifically shown, the housing 12 may also be joined to the carrier strip 19 along an edge 21 formed between sidewalls 16 and the pin entry end 15 of the housing 12. Additionally, the housings 12 are positioned in uniformly spaced apart relationship. In certain applications, it is desireable to have physical access to the terminal 13 for testing or other purposes after the connector 10 has been installed. Accordingly, in the illustrative connector a port 22 is provided in one or both of the sidewalls 16 of the housing 12, suitably dimensioned such that entry to the housing cavity 18 by a probe or other testing device is made possible. Formed internally to the housing 12 in the end walls 17 thereof are a pair of the channels 23 for slidingly receiving the terminal 13.

The terminal 13 is stamped and formed from sheet metal and has a continuous carrier strip 24 having pilot holes 25 which facilitate the proper advancement of the terminals in manufacture and allow for convenient removal of the connector 10 from mated relationship with the pin members 11 after installation. Each terminal has two contact arms 26 extending in cantilevered manner from a connecting bussing portion 27. A centrally positioned tongue 28 connects the bussing portion 24 to the carrier strip 24. Prior to assembly of the connector 10, carrier strip 24 is severed into sections having a width which is equal to or slightly less than the dimension across the housing cavity 18 at the channels 23 formed in the housing end walls 17. Ears 29 extend from the bussing portion 27 such that the terminal width at the bussing portion 27 is approximately equal to the width of the severed carrier portion 24. The terminal 13 is thereby restrained from relative movement with respect to the housing 12 once it is assembled in seated position within the channels 23. A locking lance 30, is struck from tongue 28.

Figure 2:
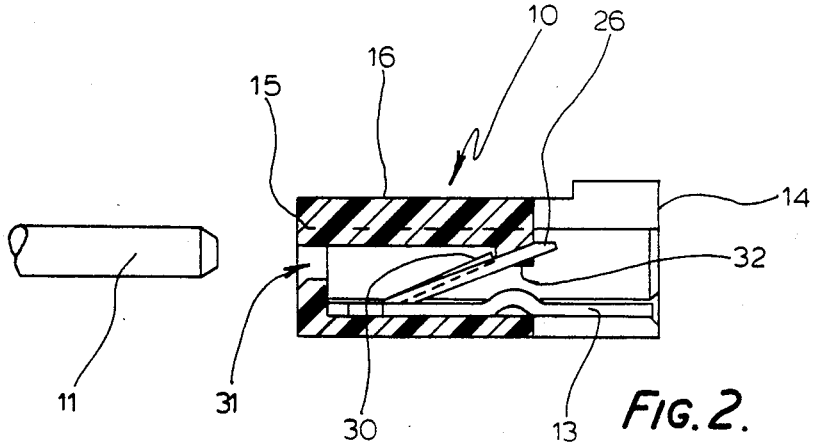
FIG. 2 is a side sectional view of the connector of FIG. 1 prior to mating with a typical male pin element.

Turning now to FIG. 2, the connector 10 is shown fully assembled and in mating orientation with a typical printed circuit board pin 11. Suitable apertures 31 are formed in end 15 of the housing 12 to provide alignment of the pins 11 with respective contact arms 26 of the terminal 13. Internal to the housing is a land 32 formed integrally with side wall 16. As shown in FIG. 2, the land 32 cooperates with the lance 30 of the terminal 13 and prevents inadvertent withdrawal of the terminal 13 from the housing 12 upon pin insertion. In a manner well known in the art, the land 32 may be formed on either side wall 16, so long as the lance 28 is suitably cooperable with the land 32 to prevent terminal withdrawal.

Figure 3:
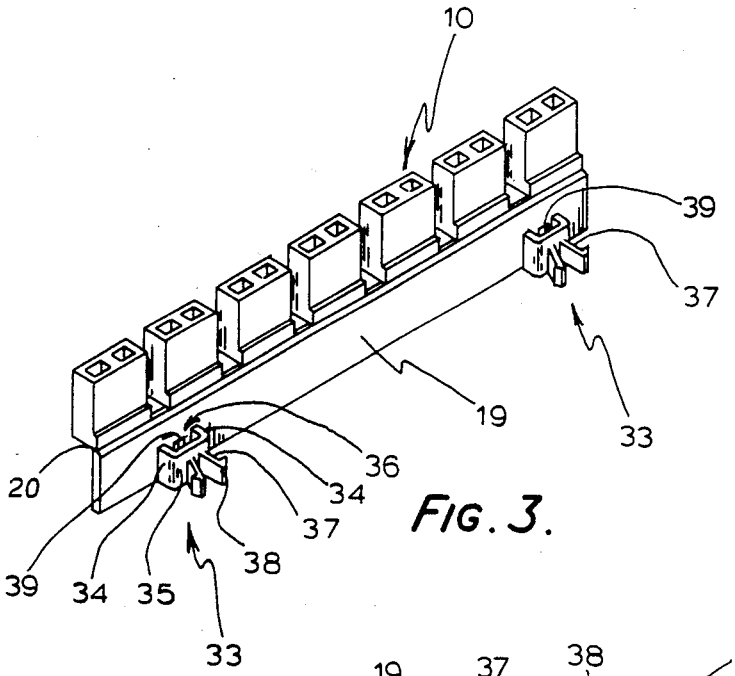
FIG. 3 is a perspective view of a plurality of connector housings in accordance with the present invention.

Referring now to FIG. 3, one side of the housing carrier 19 is adapted with integrally formed protrusion means, generally designated 33, extending therefrom and positioned along the carrier 19 at preselected regular intervals. The protrusion means 33 are configured such that they each comprise a pair of side walls 34 joined by a platform 35 which, in concert with the carrier 19, define a cavity 36. Extending from each platform 35 and molded integrally, therewith, are pairs of resilient latching fingers 37 each having a hook-shaped end portion 38. Aligned with the longitudinal axis of each pair of latching fingers 37 is an aperture 39 extending through the housing carrier 19.

Figure 4:
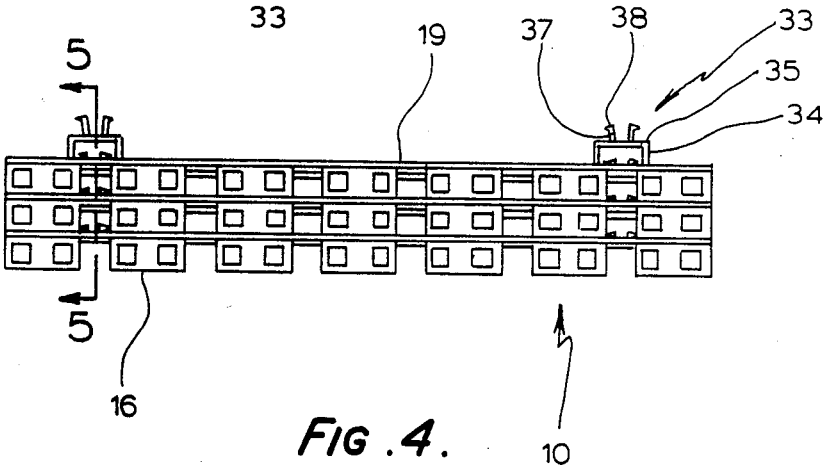
FIG. 4 is a top plan view of a plurality of connector housings shown as assembled in adjacent rows in accordance with the present invention.
Figure 5:
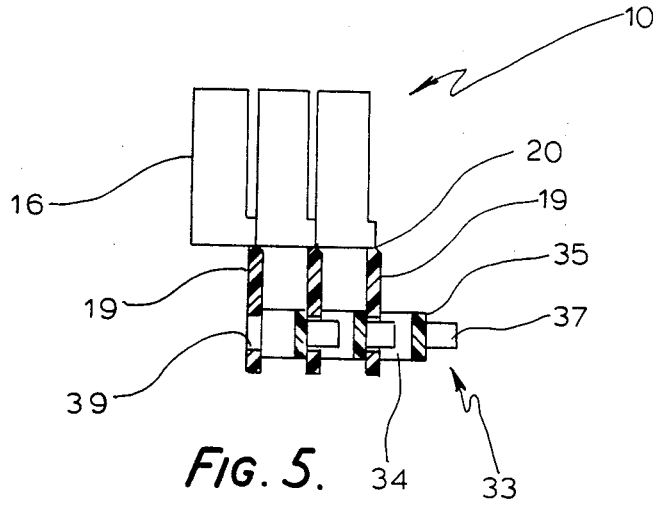
FIG. 5 is a side sectional view taken substantially on line 5—5 of FIG. 4.

In FIGS. 4 and 5, the operation of the latching feature of the present invention is illustrated. Where it is desired that electrical connectors are available for use in quantity, the connectors 10 of the instant invention may be assembled for convenient packaging and handling by latching together the housing carriers 19 in any preselected number of units, with rows of carriers 19 arranged in parallel, adjacent relationship separated by the protrusion means 33. The apertures 39 are so configured as to receive the resilient latching fingers 37 and compress them together such that the carriers 19 may be snapped together or apart manually with ease. The cavities 36 serve to permit the resilient fingers 37 to suitably expand after insertion in their respective apertures 39 such that the hook-shaped ends 38 of the fingers 37 catch the edges of the apertures 39. Thus the integrity of the connector assemblage as a unitary structure is maintained in handling and in use. Where fewer connectors 10 are desired, the carriers 19 may be conveniently separated and any desired number of connectors 10 may be freed from their respective carriers 19 by pivotal movement of the housings 12 with respect to the carriers 19 about the housing edges 20, 21 forming the juncture with the carriers 19.

As best shown in FIGS. 4 and 5, for optimum compactness and consequent packaging efficiency, it is desirable to arrange the rows of connectors 10 such that adjacent connectors 10 are in abutment with each other and their respective side walls 16 are substantially parallel. To this end, it is preferable to construct the protrusion means 33 such that the combined width of the protrusion means 33 and thickness of the carrier strip 19, as viewed in FIG. 5, is approximately equal to the width of the connector 10. This requires, of course, that the side walls 34 of the protrusion means 33 be suitably dimensioned in width to space the carriers 19 apart on centers equal in distance to the largest width dimension of the connector 10. In this manner, the connectors 10 may be stacked side-by-side in any desired number of carrier rows for efficient packaging and convenient handling.

Figure 6:
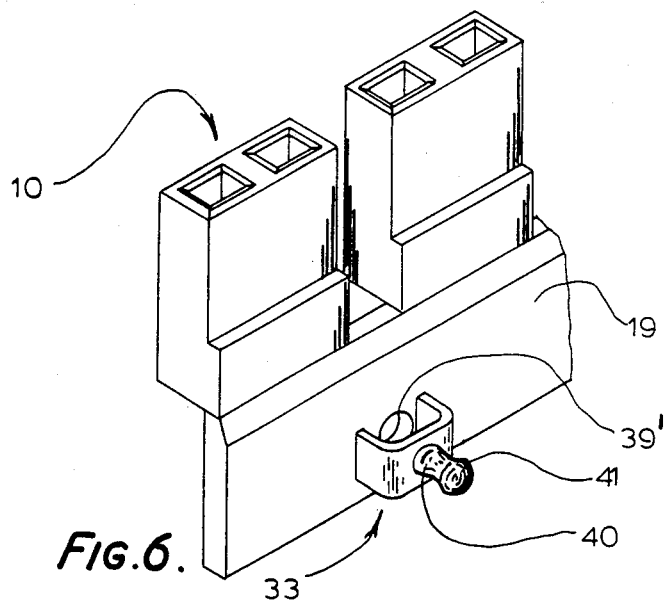
FIG. 6 is a partial perspective view illustrating an alternative embodiment of the instant invention; and FIGS. *7a* and *7b* illustrate a further embodiment of the present invention, with FIG. *7a* being a partial perspective view thereof and FIG. *7b* taken generally on line *7b*—*7b* of FIG. *7a*.

The instant invention also contemplates alternative means for latching together the carriers 19 of adjacent connector rows. As illustrated in FIG. 6, for example, the protrusion means 33 may be adapted with a single latching projection 40 configured at its end portion with an integrally formed bulb 41. Correspondingly, the apertures 39 of the carriers 19 are configured to receive the bulbs 41 with a snap together fit. In this embodiment, a round aperture 39 may be provided in the carriers 19 to cooperate with the bulbous end portion 41 of the latching projection 40.

Figure 7:
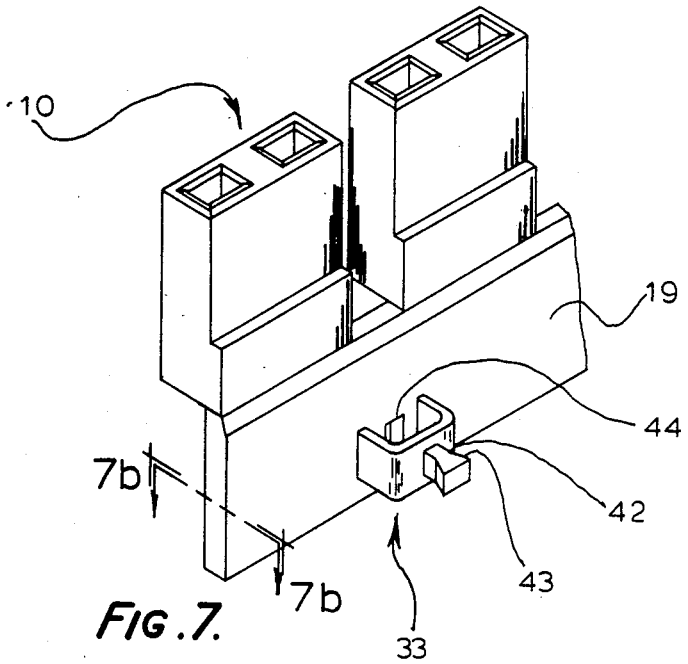
Figure 8:
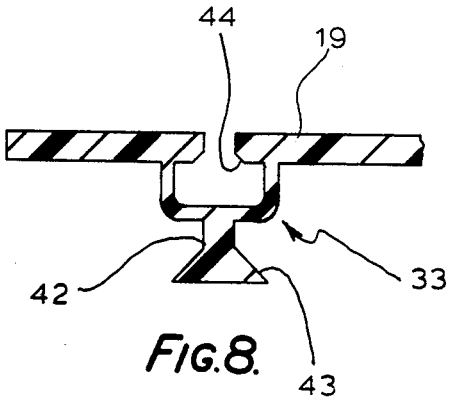

As shown in FIGS. 7*a* and 7*b* a dovetail arrangement is also suitable for latching the carriers 19 together. In such arrangement, a projection 42 extends from the protrusion-means 33 having a widened end portion 43. The projection 42 is so formed as to be slidingly received by a chamfered slot 44 formed in the carrier 19 positioned centrally of the protrusion means 33. In this manner, the carriers 19 of adjacent rows of connector 10 may be interlocked one to another by the frictional interengagement between the slot 44 and the widened portions 43 of the projections 42.

We claim:

1. A packaging arrangement for assembling at least two side-by-side parallel rows of connector housings, each row including a plurality of connector housings adapted to receive terminal means therein and similarly oriented and joined together by a common elongated integrally formed carrier strip, said arrangement comprising:

each carrier strip having a first and a second side; and interengaging latching means cooperating between the first side of one strip and the facing second side of the adjacent strip for selectively attaching the rows together.

2. The packaging arrangement of claim 1 wherein said latching means includes a pair of resilient fingers extending outwardly from the first side of the carrier strip and which is adapted to be received by an aperture formed in the carrier strip of an adjacent row and said fingers each having a hooked-shaped end portion for engagement with an edge of said aperture.

3. The packaging arrangement of claim 2 including protrusion means formed on the first side having a platform spaced from the first side from which the fingers extend, said aperture being located in alignment with said platform, whereby the fingers of the adjacent strip are received through the aperture from the second side thereof with the end portions positionable between the platform and the first side of the strip.

4. The packaging arrangement of claim 3 wherein the housings are displaced laterally with respect to said carrier strip, the distance between the first side of the carrier strip and the end portions of the fingers being equal to or greater than the distance by which the housings are displaced with respect to said strip.

5. A packaging arrangement for assembling at least two side-by-side parallel rows of connector housings, each row including a plurality of connector housings adapted to receive terminal means therein and similarly oriented and joined together by a common elongated integrally formed carrier strip, said arrangement comprising:

said carrier strip having protrusion means extending from a side thereof, said protrusion means being dimensioned such that the combined width of said protrusion means and said carrier strip is equal to or greater than the width of said connector housings, said protrusion means further having latching means extending therefrom and outwardly of said carrier, said latching means including a pair of resilient fingers having hook-shaped end portions and being adapted for engagement with an aperture of an adjacent carrier strip for selectively latching said carrier strips and connectors together in said side-by-side adjacent relationship.

6. The packaging arrangement of claim 1 wherein said latching means includes a protrusion having a bulbous end portion which is interengagable with an aperture of said adjacent carrier strip for selectively attaching said rows of connector housings together.

7. The packaging arrangement of claim 1 wherein said latching means includes a dovetail protrusion which is interengagable with a slot of said adjacent carrier strip for selectively attaching said rows of connector housings together.

* * * * *